US006452465B1

(12) United States Patent
Brown et al.

(10) Patent No.: US 6,452,465 B1
(45) Date of Patent: Sep. 17, 2002

(54) HIGH QUALITY-FACTOR TUNABLE RESONATOR

(75) Inventors: Andrew Brown, Plymouth; Gabriel Rebeiz, Ann Arbor, both of MI (US)

(73) Assignee: M-Squared Filters, LLC, Plymouth, MI (US)

( * ) Notice: Subject to any disclaimer, the term of this patent is extended or adjusted under 35 U.S.C. 154(b) by 0 days.

(21) Appl. No.: 09/604,481

(22) Filed: Jun. 27, 2000

(51) Int. Cl.[7] ..... H01P 1/20

(52) U.S. Cl. ..... 333/205; 333/235

(58) Field of Search ..... 333/205, 235

(56) References Cited

U.S. PATENT DOCUMENTS

| | | | | | |
|---|---|---|---|---|---|
| 5,367,136 | A | | 11/1994 | Buck | 200/600 |
| 5,511,238 | A | * | 4/1996 | Bayraktaroulu | 455/81 |
| 5,619,061 | A | | 4/1997 | Goldsmith et al. | 257/528 |
| 5,638,946 | A | | 6/1997 | Zavracky | 200/181 |
| 5,808,527 | A | * | 9/1998 | De Los Santos | 333/205 |
| 5,959,516 | A | | 9/1999 | Chang et al. | 334/14 |
| 5,994,796 | A | | 11/1999 | De Los Santos | 307/113 |
| 5,994,982 | A | | 11/1999 | Kintis et al. | 333/235 |
| 6,020,564 | A | | 2/2000 | Wang et al. | 200/181 |
| 6,043,727 | A | * | 3/2000 | Warneke et al. | 333/205 |
| 6,143,997 | A | * | 11/2000 | Feng et al. | 200/181 |

OTHER PUBLICATIONS

Philip S. Carter, Jr., "Magnetically–Tunable Microwave Filters Using Single–Crystal Yttrium–Iron–Garnet Resonators," IRE Transactions on Microwave Theory and Techniques, pp. 252–260, May 1961.

A.P. Benguerel and N.S. Nahman, "A Varactor Tuned UHF Coaxial Filter", IEEE Transactions on Microwave and Techniques, pp. 468–469, May 1964.

George L. Matthaei, "Magnetically Tunable Band–Stop Filters," *IEEE Transactions on Microwave Theory and Techniques*, pp. 203–212, Mar. 1965.

I.C. Hunter and John David Rhodes, "Electronically Tunable Microwave Bandstop Filters," IEEE Transactions on Microwave Theory and Techniques, Col. 30, No. 9, pp. 1354–1360, Sep. 1982.

(List continued on next page.)

*Primary Examiner*—Robert Pascal
*Assistant Examiner*—Joseph Chang
(74) *Attorney, Agent, or Firm*—Law Offices of Dick and Harris

(57) ABSTRACT

A high quality-factor, tunable radio frequency or microwave resonator is disclosed. The resonator includes one or more microelectromechanical switches positioned along its length. The switches are comprised of metal membrane bridges spanning the microstrip resonator. The bridges are connected to radial stubs that comprise reactive loads. An electrostatic potential differential between the bridge and microstrip resonator causes the bridge to collapse, thereby coupling a radial stub to the microstrip. The imposition of the reactive loads on the resonator causes the resonant frequency to change. Multiple resonators employed in a filter configuration can be variably coupled using microelectromechanical bridges that engage or disengage capacitive air gaps between two microstrip lines, to control filter bandwidth over wide tuning ranges.

14 Claims, 6 Drawing Sheets

OTHER PUBLICATIONS

I.C. Hunter and John David Rhodes, "Electronically Tunable Microwave Bandpass Filters,"IEEE Transactions on Microwave Theory and Techniques, vol. 30, No. 9, pp. 1361–1367, Sep. 1982.

Mehrdad Mehdizadeh and bernard Smilowitz, "High Speed Varactor Tuned Filter," IEEE MTT–S Digest, pp. 531–534, Jun. 1985.

Mitsuo Makimoto and Morikazu Sagawa, "Varactor Tuned Bandpass Filters Using Microstrip Line Ring Resonators," IEEE MTT–S Digest, pp. 411–414, Jun. 1986.

Kai Chang, Scott Martin, Funchen Wang, and James L. Klein, "On the Study of Microstrip Ring and Varactor–Tuned Ring Circuits," IEEE Transactors on Micowave Theory and Techniques, vol. 35, No. 12, pp. 1288–1295, Dec. 1987.

D. Auffray and JL. LaCombe, "Electronically Tunable Band–Stop Filter," IEEE MTT–S Digest, pp. 439–442, Jun. 1988.

Yong–Hui Shu, Julio Navarro, and Kai Chang, "Electronicallt Switchable and Tunable Coplanar Waveguide–Slotline Band–Pass Filters," IEEE Transactions on Microwave Theory and Techniques, vol. 39, No. 3, pp. 548–554, Mar. 1991.

Jarslow Uher and Wolfgang J.R. Hoefer, "Tunable Microwave and Millimeter–Wave Band–Pass Filters," IEEE Transactions on Microwave Theory and Techniques, vol. 39, No. 4, pp. 643–653, Apr. 1991.

Julio A. Navarro and Kai Chang, "Varactor–Tunable Uniplanar Ring Resonators," IEEE Transactions on Microwave Theory and Techniques, vol. 41, No. 5, pp. 760–766, May 1993.

Chuck Goldsmith, Tsen–Hwang Lin, Bill Powers, WenRong Wu and Bill Norvell, "Micromechanical Membrane Switches for Microwave Applications," *IEEE MTT–S Digest*, pp. 91–94, Jun. 1995.

D. K. Paul, M. Michael, and K. Konstatinou, "MMIC Tunable Bandpass Filter Using a Ring Reonator with Loss Compensation," *IEEE MTT–S Digest*, Jun. 1997.

Elliot R. Brown, "RF–MEMS Switches for Reconfigurable Integrated Circuits." *IEEE Transactions on Microwave Theory and Techniques*, vol. 46, No. 11, pp. 1869–1880, Nov. 1998.

Chuck Goldsmith, "RF MEMS Devices and Circuits for Radar and Receiver Applications," *MTT Workshop on Microwave and Photonic Applications of MEMS*, Jun. 16, 2000.

* cited by examiner

HIGH QUALITY-FACTOR TUNABLE RESONATOR

BACKGROUND OF THE INVENTION

1. Field of the Invention

This invention relates in general to tunable resonators. In particular, the invention relates to the use of a novel high frequency resonant structure which in the embodiment illustrated employs microelectromechanical techniques to achieve a high quality factor and precision tuning, for use in applications such as filters and voltage-controlled oscillators.

2. Background Art

Filters are crucial components of reliable radio-frequency ("RF") and microwave systems. For wireless systems to become increasingly compact and miniaturized, similarly compact filters are necessary. Furthermore, versatile systems typically require filtration of RF signals spanning widely varying frequency ranges. Thus, it is highly desirable to develop a compact filter that can be rapidly and reliably tuned over a wide frequency range.

Prior art tunable filters currently employ various types of tunable resonant structures to determine the filter's frequency response. One prior art tunable resonator is a switched-short tunable stub. The resonant frequency of a structure such as a microstrip half or quarter-wavelength resonator is determined in part by its physical length. Because the actual physical length of a microstrip is difficult to vary dynamically, prior art switched-short techniques have controlled a resonator's electrical length by placing a series of short circuits that can be switched open or closed spaced along the length of the resonant structure. In operation, a switch can be closed at a chosen position along the microstrip resonator to introduce a short circuit at that location and effectively set the electrical length of the resonator.

However, the foregoing switched-short structure suffers numerous potential drawbacks. Firstly, RF switches used in such structures are typically comprised of PIN diodes. However, PIN diodes suffer substantial power consumption due to forward biasing, high cost, and non-linearity. Another option that has been proposed for use as an RF switch in resonant structures utilizes microelectromechanical systems ("MEMS") technology. A MEMS switch comprises a metallic bridge that can be temporarily collapsed into a conductive position via electrostatic attraction. Upon removal of the electrostatic force, the collapsed bridge of rigid metal reverts to its original shape, thereby "opening" the switch. However, switched-short resonant structures utilizing MEMS switches require one switch for each possible tuning position; thus, a large number of MEMS switches must be fabricated for highly tunable structures. This large number of switches results in increased manufacturing costs, and reduced reliability. It is therefore an object of this invention to provide a MEMS tunable resonator which enables a large number of tuning combinations while only requiring the fabrication of a small number of MEMS switches.

The prior art switched-short structures also suffer a low quality factor. While a MEMS switch would ideally provide an absolute short circuit at its selected position on the resonator, in reality a finite amount of electrical resistance is necessarily introduced by the metallic switch structure. Furthermore, on the switched-short resonant structure the resistance of the MEMS switch is inherently located at a current maximum on the resonator standing wave, thereby maximizing the undesired power dissipation in the switch.

This non-ideality substantially limits the quality factor that can be attained by prior art resonators employing the MEMS switched-short structure. In turn, filters fabricated with such low quality factor resonators have insufficient frequency selectivity for many applications. Therefore, it is a further object of this invention to provide a MEMS tunable resonant structure that can achieve an extremely high quality factor.

Another prior art method of tuning resonant structures is by applying a varactor at the end of the structure. Typically, prior art varactor-loaded resonators have utilized a solid state varactor diode placed at the end of a quarter-wave or half-wave structure. The diode is then tuned using an analog control signal. However, because the solid state varactor requires an analog bias to control tuning, it is highly susceptible to line noise and phase noise that may be coupled onto the bias line from surrounding circuitry. It is therefore an object of this invention to provide a resonator that is tuned digitally, thereby avoiding the susceptibility to noise that is introduced by an analog control signal.

When a filter is created using varactor-loaded resonators, the filter transfer function is inherently nonlinear because prior art varactors typically exhibit nonlinear characteristics. As a result of such a nonlinear filter transfer function, filters formed with varactor-loaded resonators typically suffer very low second order and third order intercept points. Thus, varactor-loaded resonators are often only useful for a limited number of applications, such as receivers exposed only to extremely low power levels. It is therefore an object of this invention to provide a versatile tunable filter with a highly linear transfer function.

Prior art filters using varactor-loaded resonators also suffer high insertion loss due to the significant series resistance inherent in varactor diodes. The insertion loss problem becomes particularly significant when multiple resonators are required to achieve a desired filter performance. Therefore, it is an object of this invention to minimize the insertion loss inherent in the use of a tunable resonant structure.

While varactors fabricated using MEMS techniques have been proposed to replace the solid-state varactors previously utilized in varactor-loaded resonant structures, both MEMS and solid-state varactors are significantly limited in their usable capacitance variation. Prior art MEMS varactors are typically limited to a capacitance variation of approximately 1.3:1. Therefore, neither MEMS nor solid-state varactor-loaded resonators offer a wide tuning range. It is therefore an object of this invention to provide a tunable resonant structure employing MEMS technology to implement a very wide tuning range.

Some prior art filter designs utilize multiple resonators that are capacitively coupled together. However, the coupling coefficients of typical prior art capacitive coupling techniques vary over frequency. When a tunable filter employs such coupling, the varying coupling coefficients may alter the filter response as it is tuned across a broad frequency range. Because such variation is undesirable in many applications, it is an object of this invention to provide a structure with a variable, tunable coupling coefficient.

These and other objects of the present invention will become apparent to those of ordinary skill in the art in light of the present specifications, drawings and claims.

SUMMARY OF THE INVENTION

The invention allows for the tuning of a radio frequency or microwave resonator over a wide frequency bandwidth, thereby providing for the implementation of high quality-factor tunable filters. The tunable resonator is comprised of a microstrip configuration of predetermined length.

Microelectromechanical switches are located at one or more positions along the length of the microstrip. The switches are MEMS bridges comprised of spans of a metal membrane crossing over the microstrip, with an air gap between the membrane and microstrip. Each bridge is also connected at one end to a radial stub, which can act as a capacitive load. When an electrostatic potential differential is applied between the bridge and the microstrip, the bridge collapses, thereby forming an electrical connection between the microstrip and radial stub. The radial stub loads the microstrip to create a slow wave structure, thereby lowering the resonant frequency of the microstrip. When the electrostatic potential differential between the bridge and microstrip is removed, the bridge reverts to its prior position above the microstrip, thereby disconnecting the load from the microstrip, and increasing the resonant frequency of the resonator. A large number of resonator tuning states can be achieved as multiple switches at various positions along the resonator engage and disengage the various capacitive loads.

Multiple resonator stubs can be combined to create various filter configurations, as is known in the art. Resonator stubs can be coupled using direct connections or capacitive air gaps. However, because filters created using the disclosed tunable resonators can cover a wide tuning frequency range, it may also be desirable. to control the coupling coefficient to resonators by implementing a tunable coupling configuration. One or more MEMS bridges span a first microstrip. Each MEMS bridge is separated from a resonator microstrip by a predetermined capacitive air gap. When a bridge is collapsed into a closed state by an electrostatic potential differential between it and the first microstrip which it spans, the bridge becomes coupled with the first microstrip, such that the first microstrip is further coupled to the resonator microstrip via the predetermined capacitive air gap between the resonator and the bridge. When the electrostatic potential differential is eliminated, the bridge returns to its open state and the microstrips are no longer coupled by the predetermined capacitive air gap associated with the bridge. The first microstrip and the resonator microstrip can also be positioned in close proximity such that they are capacitively coupled via a permanent air gap even when each coupling bridge is in an open state. Thus, the coupling capacitance between microstrips can be adjustably controlled.

DETAILED DESCRIPTION OF THE DRAWINGS

Figure 1:
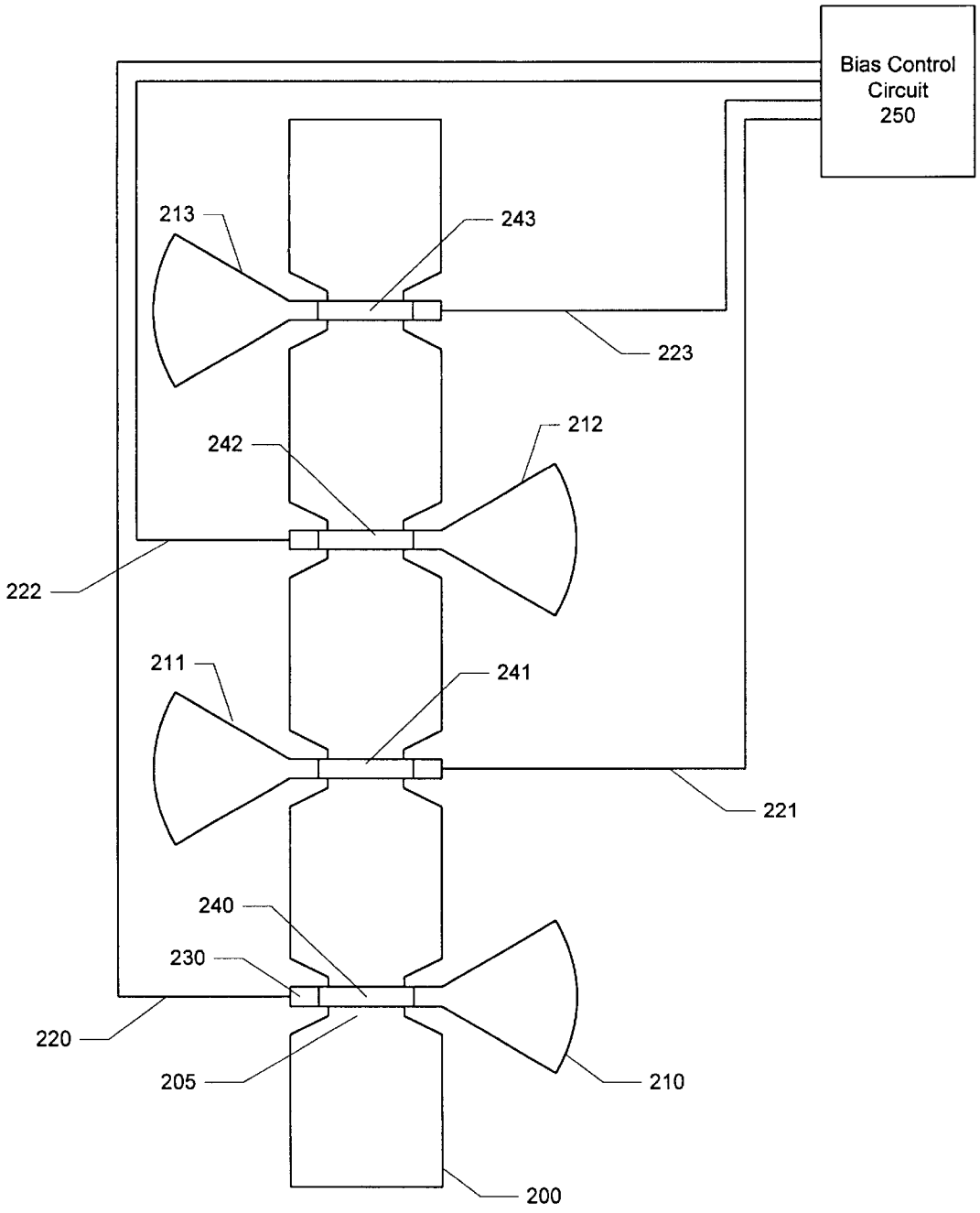
FIG. 1 is a top plan view of a resonator structure employing collapsible MEMS bridges to variably engage capacitive loads at various positions.

While this invention is susceptible to embodiment in many different forms, there are shown in the drawings and will be described in detail herein several specific embodiments. The present disclosure is to be considered as an exemplification of the principle of the invention intended merely to explain and illustrate the invention, and is not intended to limit the invention in any way to embodiments illustrated.

FIG. 1 illustrates a tunable resonator according to a first embodiment of the invention. The resonator includes RF microstrip 200. Microstrip 200 includes a plurality of collapsible MEMS bridges 240, 241, 242, and 243. Each MEMS bridge 240–243 is connected to an associated reactive load 210–213, respectively. In the preferred embodiment of the invention, reactive loads 210, 211, 212, and 213 are microstrip radial stubs. Radial stubs are preferred for the present wide-range tunable resonator because they function more ideally as capacitive loads over a wide bandwidth; however, it is contemplated that other reactive structures known in the art could be readily substituted.

Each MEMS bridge 240–243 is also connected to a bias line, 220–243, respectively. Bias lines 220–243 are controlled by bias control circuit 250. For example, bridge 240 is connected to bias line 220 whereby bridge 240 is electrostatically switched between the open and closed positions through the application of a DC voltage to bias line 220 by control circuit 250. Because the MEMS bridges are electrostatically controlled, current flow during switching is negligible; therefore, the bias lines are preferably resistive lines, as the use of high impedance lines reduces parasitic coupling with other proximately positioned circuit structures. When switched into the closed position, the MEMS bridges couple their corresponding radial stubs to the microstrip line at the position at which the bridge spans the resonator. Each MEMS bridge discussed herein is controlled by an associated bias line and a bias control circuit; however, in some drawings, control lines have been omitted for clarity.

While the embodiments illustrated incorporate electrostatically-actuated MEMS bridges as high-frequency switches to couple and decouple reactive loads with the resonator with minimal noise and impedance, it is contemplated that other switch structures could be readily implemented without departing from the scope of the invention disclosed. For example, the invention might be implemented with thermally-actuated MEMS switches, scratch drive MEMS switches, or other RF switches known in the art capable of coupling reactive loads to a resonator with low noise and impedance. Additionally, the embodiments illustrated are fabricated on a microstrip structure. However, it is also contemplated that the invention could be readily implemented with a resonator comprised of another known type of transmission line, such as coplanar waveguide.

The presence or absence of each reactive load on the transmission line alters the resonant frequency of the resonator. Even when all bridges are open, or up, their proximity causes the resonator to become a slow wave structure. The parasitic coupling of the bridge, and in turn its associated radial stub load, to the microstrip resonator causes the resonator to behave electrically longer than its physical length would suggest in the absence of MEMS bridges. The shift in resonant frequency is a function of both the amount of switched reactance, and the position of the load along the resonator. As increasing numbers of bridges are collapsed into the closed position, and their respective capacitive loads are imposed upon the resonator, the effective wave speed of the structure further decreases; thus, the resonator appears electrically longer, and the resonant frequency decreases.

To design a resonant structure according to the present invention that performs according to specifically desired specifications, the particular MEMS bridge design utilized can be modeled using moment method electrical modeling of the bridge structure in both its open and collapsed positions. Such modeling of the electrical properties of the bridge is desired because parasitic coupling imposes significant loading on the resonator even when the bridges are in the open position. The resulting bridge model can then be applied using standard RF and microwave circuit modeling software to determine the frequency response of the resonant structure with various MEMS bridge states, bridge locations, and reactive loads. Empirical design techniques can thereby be used to achieve desired design specifications by varying both the length of the resonator, and the dimensions and positions of the radial stubs and MEMS switches.

By asserting or deasserting each bias line, the resonator of FIG. 1 can be tuned digitally. The number of tuning steps is therefore dependent on the number of MEMS bridges implemented. In the embodiment of FIG. 1, the resonator is implemented with $2^4$, or 16, tuning steps. While the resonators depicted in the present embodiment each include four switched capacitive loads for illustrative purposes, the number of loads can be selected according to the desired range and granularity of tuning.

Figure 2:
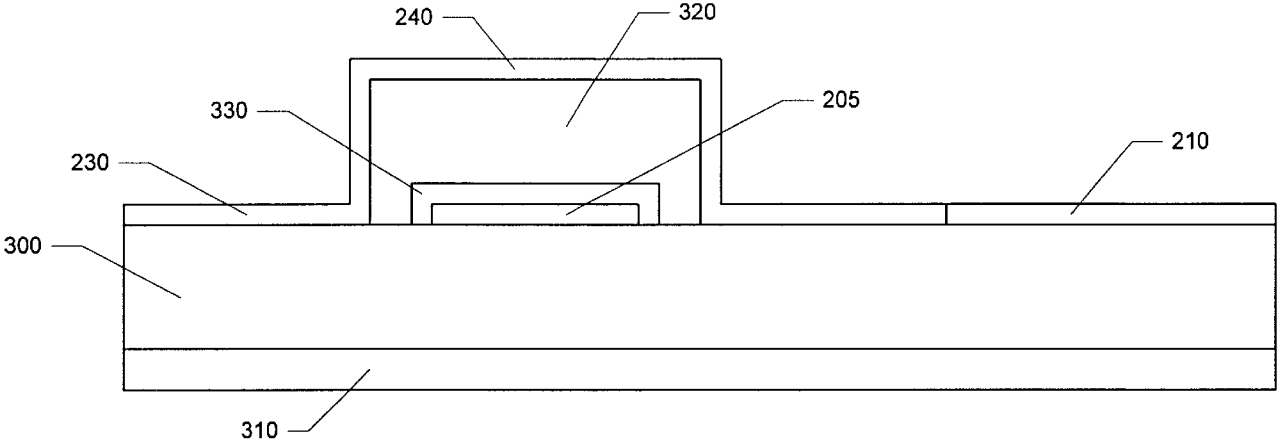
FIG. 2 is a cross-sectional elevation view of a switchable capacitive load when the MEMS bridge is in the open position.

FIG. 2 illustrates a cross-section of a tunable resonator through a MEMS bridge according to one embodiment of the invention. The resonator structure is formed upon ground plane 310 and dielectric 300. The physical dimensions of the bridge allow for it to be rapidly and reliably collapsed and reformed, as is known in the art of MEMS switching. Therefore, in the illustrated embodiment, the resonator microstrip line necks down to a reduced diameter for the portion 205 of the line passing beneath bridge 240 such that bridge 240 can be designed with appropriate dimensions. Resonator portion 205 includes dielectric coating 330 to prevent DC current flow between bridge 240 and microstrip 205 while the bridge resides in a collapsed position. Radial stub 210 is connected to one side of bridge 240 to act as a wideband reactive load. A biasing signal is applied to end 230 of bridge 240 to control whether the bridge is in the open or closed position. When in the open position, air gap 320 isolates microstrip 205 from bridge 240 and, in turn, load 210.

Figure 3:
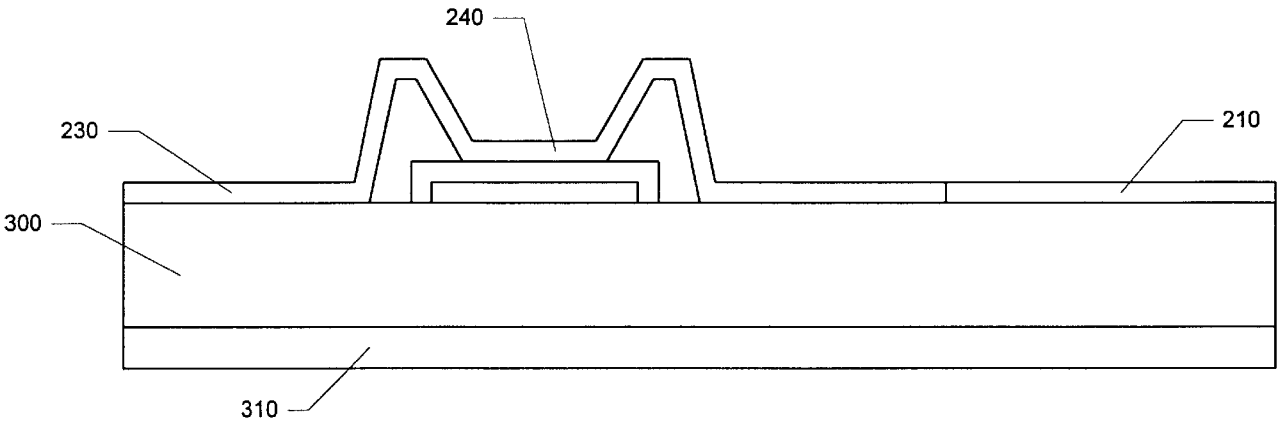
FIG. 3 is a cross-sectional elevation view of a switchable capacitive load when the MEMS bridge is in the closed position.

FIG. 3 illustrates a cross-section of a MEMS bridge once it has entered the closed state. Upon application of a bias signal to bridge portion 230, a substantial DC potential differential is built up between bridge 240 and microstrip 205. The resultant electrostatic attraction causes bridge 240 to collapse as it is attracted towards microstrip 205, as depicted in FIG. 3. While dielectric coating 330 prevents the direct conduction of current onto microstrip 205, the close proximity of collapsed bridge 240 to microstrip 205 allows for the high-frequency coupling of radial stub 210 to microstrip 205.

Figure 4:
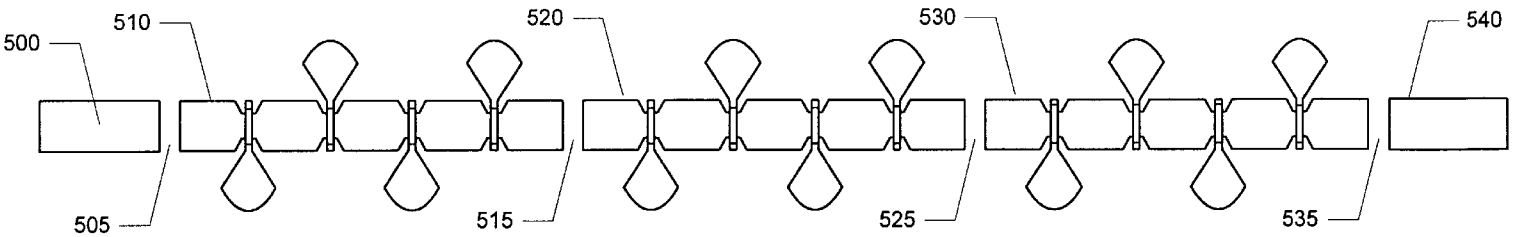
FIG. 4 is a top plan view of a switched-capacitance tunable filter comprised of capacitively coupled resonators in series.

The resonator illustrated in FIGS. 1–3 can be employed as a resonant structure in a variety of applications, such as tunable filters or tunable oscillators. FIG. 4 depicts a three-pole tunable end-coupled filter configuration using resonators similar to those of FIG. 1. A RF or microwave signal is applied to input line 500. The signal is coupled to half-wavelength resonator 510 via gap 505 at the open end of the resonator. Similarly, the signal is coupled to resonators 520 and 530, and output line 540, via gaps 515, 525 and 535 respectively. Each of resonator's 510, 520, and 530 introduces a tunable pole in the filter frequency response.

Figure 5:
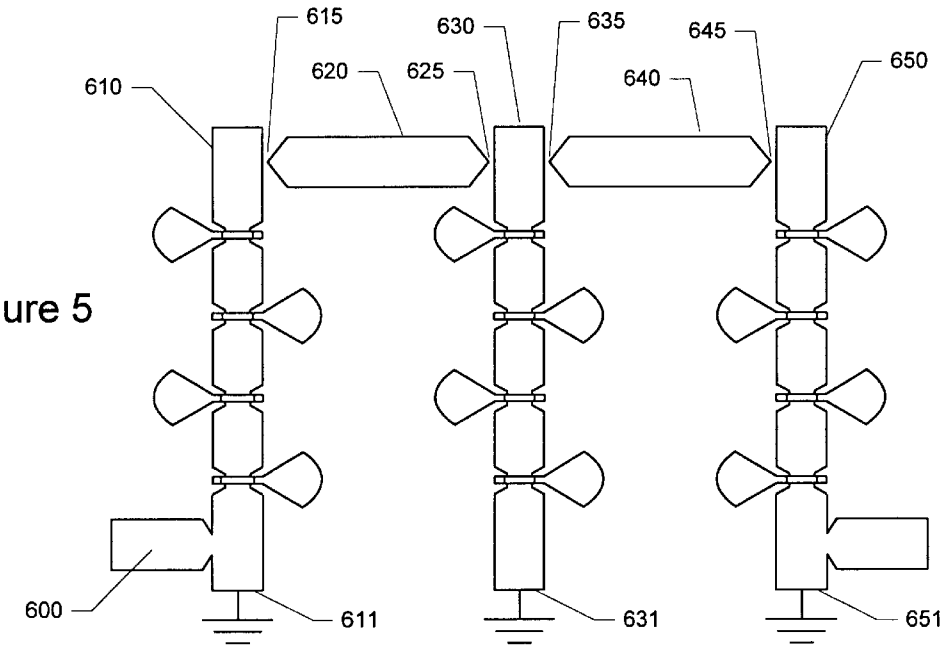
FIG. 5 is a top plan view of a quarter-wave line-coupled tunable filter.

FIG. 5 illustrates another embodiment of the present invention, comprising a quarter-wave line-coupled tunable filter. In this embodiment, a signal is input via microstrip 600 to resonator 610. Input microstrip 600 is positioned along resonator 610 at a location where the impedance of the resonator is equal to the characteristic impedance of microstrip 600, thereby achieving satisfactory input return loss characteristics. Resonators 610, 630 and 650 are shorted to ground at ends 611, 631 and 651 respectively by trimming the microstrip resonators and the fused silica substrate below with a dicing saw. The edges resulting from the dicing saw incision are metal plated, thereby connecting the resonator microstrip on the topside of the substrate with the ground plane on the bottomside of the substrate.

Quarter-wave resonators 610, 630 and 650 are coupled together at their open ends by capacitively coupled transmission lines 620 and 640. The coupling coefficient between resonators is determined by the amount of coupling capacitance due to gaps 615, 625, 635, and 645 between the resonators and coupling lines, the length of coupling transmission lines 620 and 640, and the characteristic impedance of lines 620 and 640.

While the characteristic impedances of the lines are constant over the filter tuning frequency range, both the impedance resulting from the coupling capacitance, as well as the electrical length of coupling lines 620 and 640 vary with frequency. Similarly, the resonators disclosed are of fixed physical length; therefore, the electrical length of the resonators also depend upon the frequency of signal traveling thereon. Therefore, the resulting coupling coefficients between resonators also vary over frequency. As a resonator coupling coefficient varies, so does the filter frequency response. For filters with wide tuning ranges, such as that of FIG. 5, the filter bandwidth may vary substantially over the frequency range to which the filter may be tuned. Such filter frequency response variation may be undesirable in some applications.

To address this undesired characteristic, resonators and coupling lines can be coupled using a variable coupling scheme to provide greater control over filter bandwidth and characteristics - particularly over wide tuning ranges. This aspect is demonstrated by the implementation of the tunable notch filter of FIG. 6. A high-frequency signal is applied to microstrip input 700. Resonator 770 is coupled to microstrip 700 via a variable coupling scheme that includes MEMS bridges 710 and 715. MEMS bridges 710 and 715 are similar in construction to bridge 240, described above and depicted in FIGS. 2 and 3.

Figure 7:
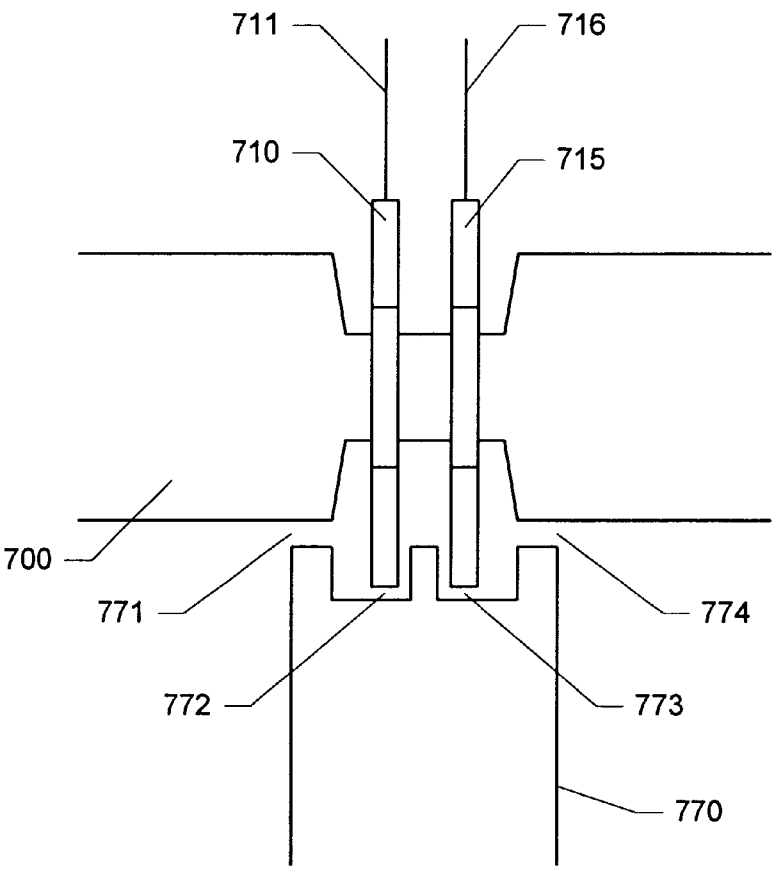
FIG. 7 is a closeup top plan view of a variable capacitive coupling mechanism using collapsible MEMS bridges.

FIG. 7 shows a closeup view of the variable resonator coupling apparatus. Resonator 770 is always coupled to microstrip 700 via capacitive gaps 771 and 774. When a bias signal is applied to bridge control line 711, bridge 710 collapses into its closed position; microstrip 700 is additionally coupled to resonator 770 through bridge 710 and capacitive gap 772. Likewise, when a bias signal is applied to bridge control line 716, bridge 715 collapses into its closed position; microstrip 700 is additionally coupled to resonator 770 through bridge 715 and capacitive gap 773. Accordingly, the coupling capacitance between microstrip 700 and resonator 770 can be controlled to one of four possible values, depending upon the state of bias lines 711 and 716. Furthermore, while the embodiment depicted demonstrates a four-state coupling scheme with two MEMS bridges, it is envisioned that a greater or fewer number of states can be readily implemented by changing the number of bridges, and associated switched coupling capacitances.

Figure 6:
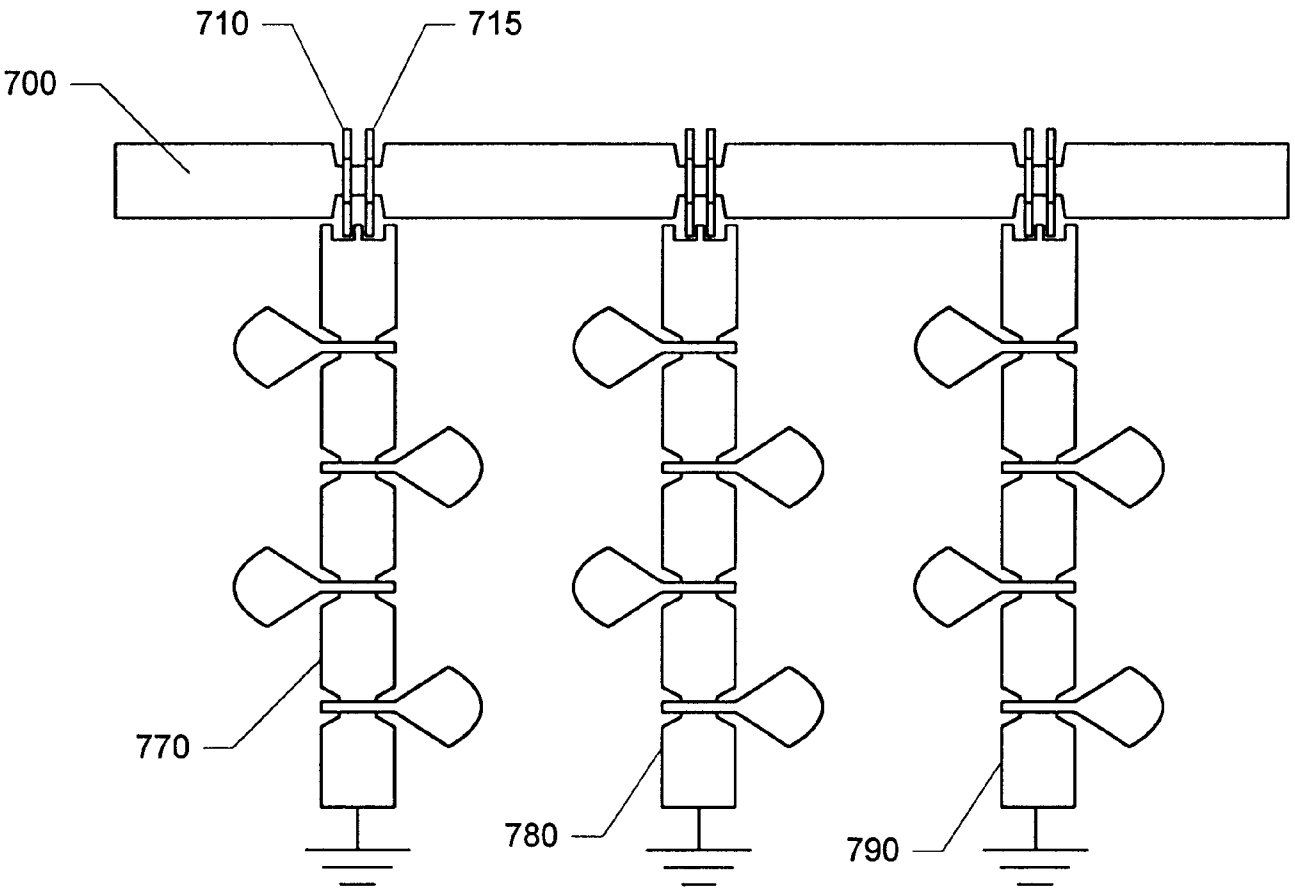
FIG. 6 is a top plan view of a tunable filter with variably coupled tunable resonator stubs.

The tuning capabilities of the filter of FIG. 6 allow for rapid and powerful configurability. For example, the three resonators 770, 780, and 790 can each be tuned identically to create a single 3-pole notch filter with variable center frequency. However, resonators 770, 780 and 790 can also be controlled independently to, for example, reconfigure the filter to provide three single-pole notches, or one single-pole notch and one two-pole notch. Additional resonators may be provided to enable greater degrees of configurability. Thus, the present invention may be effective in applications such as filtering multiple jamming signals in cluttered environments, where it may be desirable to trade off in mid-operation between the number of notched frequencies and the attenuation level at each notch.

Figure 8:
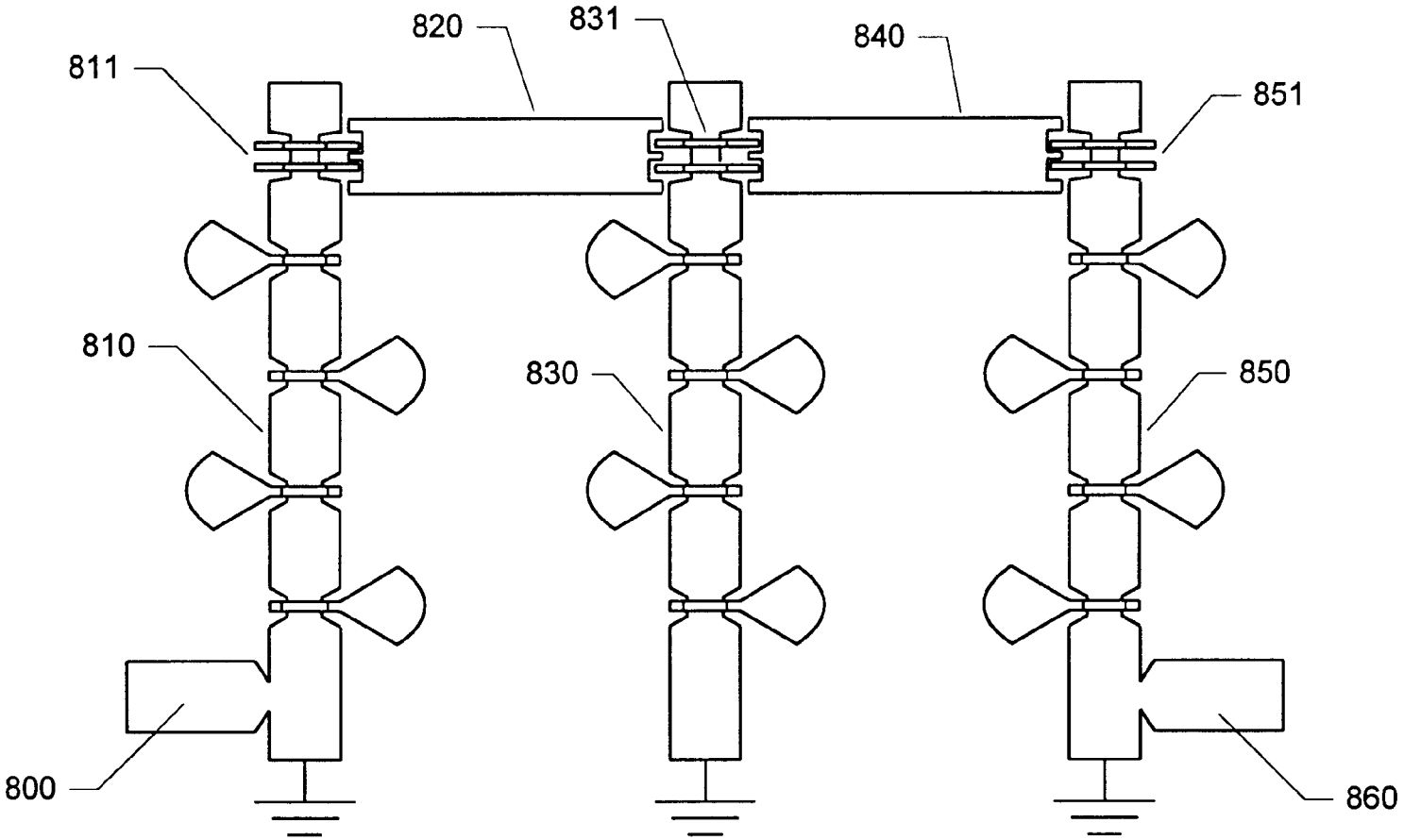
FIG. 8 is a top plan view of a constant-bandwidth, wide range tunable bandpass filter with variable resonator coupling.

Finally, the embodiment of FIG. 8 illustrates a configuration implementing a constant-bandwidth, wide-range tunable bandpass filter. A signal is applied to input microstrip 800, and a filtered signal is received at output microstrip 860. Tunable resonators 810, 830, and 850 are arranged in a bandpass configuration. The resonators are coupled with coupling lines 820 and 840. Furthermore, the coupling coefficients between resonators and coupling lines is variable. Variable coupling mechanisms 811, 831, and 851 are each analogous to the mechanism illustrated in FIG. 7, being comprised of both fixed capacitive gaps, providing a constant coupling capacitance, and MEMS bridge structures, which can be switched to vary the coupling capacitance between the resonators and coupling lines. Therefore, as resonators 810, 830, and 850 are controlled to tune the bandpass filter to varying frequencies, the coupling capacitance of coupling mechanisms 811, 831 and 851 can also be tuned, thereby maintaining a desired filter bandwidth across a widely varying range of center frequencies.

The foregoing description and drawings merely explain and illustrate the invention and the invention is not limited thereto except insofar as the appended claims are so limited, inasmuch as those skilled in the art, having the present disclosure before them will be able to make modifications and variations therein without departing from the scope of the invention.

I claim:

1. A tunable resonator for use in filtering radio frequency electromagnetic signals, which resonator is comprised of:

a microstrip conductor fabricated on a dielectric substrate;

a microelectromechanical bridge that spans the microstrip conductor, the bridge assuming either a resting state in which the bridge is not coupled to the microstrip, or a collapsed state in which the bridge is coupled to the microstrip;

a bias circuit connected to the microelectromechanical bridge that can impose an electrostatic potential differential between the bridge and the microstrip to cause the bridge to enter its collapsed state;

an open radial stub connected to the bridge, such that the stub is coupled to the microstrip when the bridge is in the collapsed state, and the stub is not coupled to the microstrip when the bridge is in the resting state;

whereby the frequency to which the resonator is tuned is determined by the state of the microelectromechanical bridge.

2. A tunable resonator responsive to radio frequency electromagnetic signals, which resonator is comprised of:

a transmission line of predetermined physical length;

one or more radio frequency switches positioned proximately to the transmission line, each switch having a closed position and an open position;

one or more reactive loads, each load being connected to a respective one of the one or more radio frequency switches, such that each load is coupled to the transmission line when that load's associated switch is in the closed position, and each load is decoupled from the transmission line when that load's associated switch is in the open position;

whereby the resonant frequency of the resonator is determined by the states of the one or more switches.

3. The resonator of claim 2, where the transmission line is a microstrip conductor fabricated on a dielectric substrate.

4. The resonator of claim 2, where the radio frequency switch is comprised of a microelectromechanical bridge, and the resonator further includes a bias line connected to the bridge; and a switch control circuit capable of applying an electrostatic potential differential between the bias line and the transmission line to place the switch into a closed position, and removing an electrostatic potential differential between the bias line and the transmission line to place the switch into an open position.

5. The resonator of claim 4, where the bias line is resistive with impedance greater than the characteristic impedance of the transmission line, whereby the electromagnetic coupling between the bias line and proximate circuitry is reduced.

6. The resonator of claim 4, where the microelectromechanical bridge is comprised of a metal membrane separated from the transmission line by an air gap, such that the membrane collapses towards the microstrip when the switch control circuit applies an electrostatic potential to the membrane to place the switch into its closed position.

7. The resonator of claim 6, where the region of the transmission line lying beneath the membrane is coated with a thin dielectric film, such that the film prevents direct conduction of current between the bridge and transmission line.

8. The resonator of claim 2, where the reactive load is comprised of an open radial stub.

9. A tunable filter for filtering a radiofrequency electromagnetic signal, the filter comprising:

a primary microstrip line on which the radiofrequency electromagnetic signal is conducted;

one or more resonators, where each resonator is comprised of a resonator microstrip line, a radiofrequency coupling mechanism that conveys electromagnetic energy between the resonator microstrip and the primary microstrip, one or more reactive loads, a radiofrequency switch associated with each one of the one or more reactive loads that alternatively couples the switch's associated reactive load to the resonator microstrip while in a closed state, or decouples an associated reactive load from the resonator microstrip while in an open state;

a control circuit connected to each radiofrequency switch that places each switch into either a closed or an open state.

10. The filter of claim 9, in which the radiofrequency coupling mechanism is comprised of a capacitive air gap.

11. The filter of claim 9, in which the radiofrequency coupling mechanism is comprised of one or more radiofrequency switches, where each switch couples the primary microstrip to the associated resonator microstrip with a predetermined capacitance when the switch is in the closed state, and does not couple the primary microstrip to the resonator microstrip with the predetermined capacitance when the switch is in the open state.

12. The filter of claim 11, in which each radiofrequency switch is comprised of a microelectromechanical bridge which spans one microstrip line with which the bridge is coupled; and the control circuit includes bias lines connected to each bridge, through which the control circuit can place each bridge into a closed state by applying an electrostatic potential differential between the bridge and the microstrip line that the bridge spans, thereby causing the bridge to collapse, and the control circuit can place each bridge into an open state by removing the electrostatic potential differential between the bridge and the microstrip line that the bridge spans, thereby allowing the bridge to assume its unstressed form.

13. The filter of claim 12, where each resonator microstrip is positioned in close proximity to the primary microstrip, such that a capacitive air gap is formed directly between the primary and resonator microstrip lines, whereby that capacitive air gap substantially comprises the coupling between the primary and resonator microstrip lines when the one or more radiofrequency switches between the primary and resonator microstrips are each in an open state.

14. The filter of claim 12, in which the bias lines are resistive with an impedance greater than the characteristic impedance of the microstrip lines, whereby the electromagnetic coupling between the bias line and proximate circuitry is reduced.

* * * * *